United States Patent [19]

Ellis

[11] Patent Number: 4,784,066

[45] Date of Patent: Nov. 15, 1988

[54] ADAPTER FOR A TRANSPORT SYSTEM

[75] Inventor: Bruce R. Ellis, Sheringham, England

[73] Assignee: Trailer Train Limited, United Kingdom

[21] Appl. No.: 883,569

[22] Filed: Jul. 9, 1986

[30] Foreign Application Priority Data

Jul. 10, 1985 [GB] United Kingdom ..... 8517409

[51] Int. Cl.[4] ..... B61D 3/18

[52] U.S. Cl. ..... 105/4.1; 105/4.3; 105/215.2; 410/53

[58] Field of Search ..... 105/1.4, 1.5, 3, 4.1, 105/4.3, 215.2, 215.1; 410/53

[56] References Cited

U.S. PATENT DOCUMENTS

| | | | |
|---|---|---|---|
| 2,963,986 | 12/1960 | Dobson | 105/4.1 |
| 2,992,621 | 7/1961 | Schoen | 410/53 |
| 3,557,712 | 1/1971 | Milenkovic | 105/4.1 |
| 3,802,350 | 4/1974 | Hicks | 105/4.1 |
| 3,922,971 | 12/1975 | Maroshick | 105/4.1 |
| 4,179,997 | 12/1979 | Kirwan | 410/53 |
| 4,315,465 | 2/1982 | Cordani | 105/4.5 |
| 4,405,271 | 9/1983 | Adams | 410/53 |
| 4,416,571 | 11/1983 | Krause | 105/4.1 |
| 4,428,296 | 1/1984 | Scheuchler | 105/4.1 |
| 4,669,391 | 6/1987 | Wicks | 410/53 |

FOREIGN PATENT DOCUMENTS

| | | | |
|---|---|---|---|
| 662145 | 4/1963 | Canada | 105/366 R |

*Primary Examiner*—Joseph F. Peters, Jr.
*Assistant Examiner*—Clifford T. Bartz
*Attorney, Agent, or Firm*—Wood, Herron & Evans

[57] ABSTRACT

An adapter is described for use with the road/rail transport system described in the specification of U.S. patent application Ser. No. 673,583, now abandoned. The adapter enables a train of bogies and semi-trailers as described in said specification to be connected to a locomotive or to be incorporated in a train including convention rail vehicles. The adapter comprises a headstock with buffers and means for connecting the adapter to a locomotive or conventional rail vehicle and a bolster provided with means for releasably connecting the adapter to a bogie and with means for connection to a semi-trailer. The headstock is connected to the bolster by side arms which are extended beyond the bolster and terminate in means for attaching the side arms to the base of a semi-trailer.

6 Claims, 4 Drawing Sheets

ADAPTER FOR A TRANSPORT SYSTEM

FIELD OF THE INVENTION

This invention relates to an adapter for a transport system such as that described in the specification of our U.S. patent application Ser. No. 673,583.

BACKGROUND OF THE INVENTION

U.S. Pat. No. 673,583 describes a transport system which comprises rail bogies of the kind having two axles and a central bogie bolster arranged between the axles and transverse to the intended direction of travel and semi-trailers which are preferably of the kind having road wheels at the trailing ends and adapted for connection at their leading ends to a tractor unit. The rail bogie bolster has a pocket in which a mounting member is held, the pocket and mounting member having complementary surfaces in engagement to permit limited movement of the mounting member relative to the pocket. The mounting member is adpated for releaseable attachment to the frame of a semi-trailer which at one end is provided with means for receiving the attachment of the mounting member and which at the other end is connectable to a similar semi-trailer so that a train may be constructed of semi-trailers and bogies with each bogie effectively supporting the weight of one semi-trailer. In this arrangement, one semi-trailer is movable relative to an adjacent semi-trailer about a first substantially vertical axis and the semi-trailer is pivotable relative to the bogie about a second substantially vertical axis. These vertical axes preferably coincide or substantially coincide so as to provide a considerable reduction in overthrow and diagonal racking loads as the semi-trailer negotiates a bend. The semi-trailers can readily be converted to a road mode.

Reference is directed to the aforesaid patent specification for further details of the transport system.

A train may be constructed from a plurality of the semi-trailers each of which is releasably mounted on one of the rail bogies and, as indicated, with the exception of the first and last semi-trailers, the weight of one semi-trailer is effectively supported by one rail bogie.

In order to terminate the train it is either necessary to adapt the last semi-trailer to receive the bogie by fitting a front bolster or by adapting a front bolster to receive attachment means on the bogie. This, however, may be undesirable, due to the expense involved, and it may, therefore, be preferred to provide each train with a special adapter bogie whereby the train may be connected to an engine. For reverse running a coupling member may be provided in the form of a triangular frame terminating in cups for receiving the buffers of an engine and having a tongue for coupling in the socket of a semi-trailer.

While, as described in the aforesaid patent specification, no problems arise in making up a train consisting entirely of the bogies and semi-trailers it is apparent that problems will arise if it is attempted to incorporate these units of the transport system in conventional freight trains, as several of the adapter bogies will be required, which is uneconomic. Furthermore, due to the necessity of adequately transferring the normal buff and draught loads between units of the train, the described triangular coupling members are not suitable for coupling the bogie and semi-trailer units of the transport system in freight trains including conventional rail cars.

SUMMARY OF THE INVENTION

Accordingly, it is an object of the invention to provide an adapter unit, whereby units comprising the bogies and semi-trailers of the transport system of the aforesaid patent specification can be incorporated in trains comprising conventional rail cars and whereby the said units may also be coupled to an engine.

According to the present invention there is provided an adapter for a transport system comprising bogies and semi-trailers mountable on the bogies, wherein the adapter comprises a headstock provided with buffers and means for connecting the adapter to a locomotive or conventional rail vehicle, a cross member or bolster and side arms connecting the headstock to the bolster and terminating in means for attaching the side arms to the base of a semi-trailer and wherein the bolster is provided with means for releasably connecting the adapter to a bogie and with means for connection to a semi-trailer.

Usually a semi-trailer is provided at one end with a coupling tongue and at the other end with a socket to receive the coupling tongue. The present adapter may therefore be provided with a socket to receive the coupling tongue f a leading semi-trailer, the socket and the means for holding the tongue in the socket being essentially the same as the socket and holding means at the other end of the trailer. Alternatively, the adapter may be provided with a coupling tongue to engage in the socket of a trailing semi trailer.

DETAILED DESCRIPTION OF THE DRAWINGS

In order to enable the invention to be more readily understood, reference will now be made to the accompanying drawings which illustrate diagrammatically and by way of example some embodiments thereof and in which.

Figure 1:
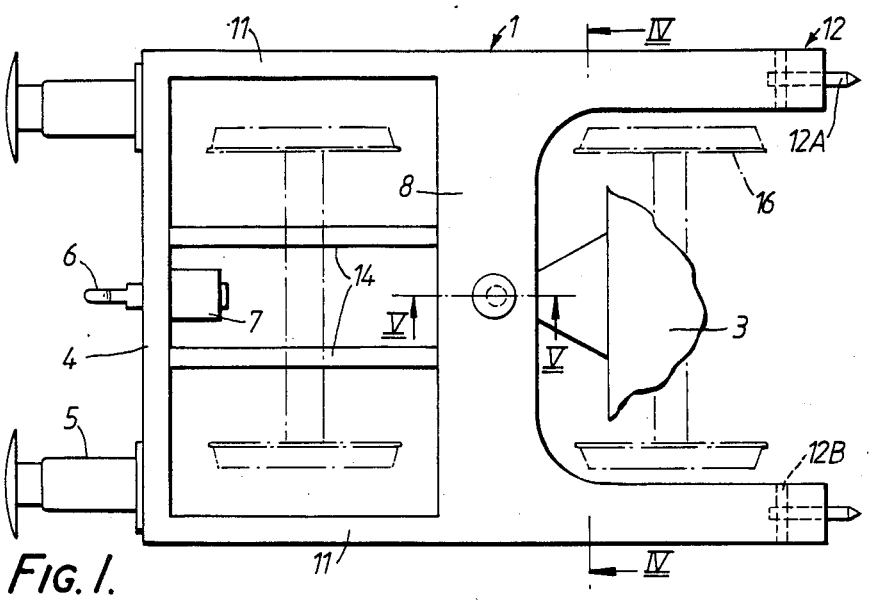
FIG. 1 is a plan view of a coupling adapter for a transport system.
Figure 2:
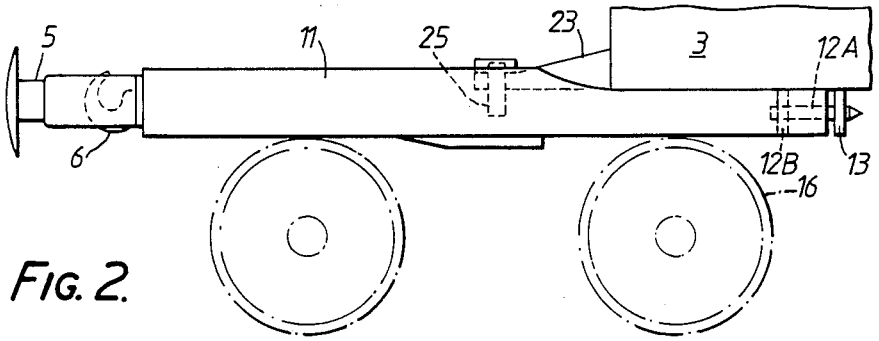
FIG. 2 is a side view of the adapter shown in FIG. 1.

Referring now to FIGS. 1 and 2, there is shown a couping adapter 1 for transport system units comprising semi-trailers supported on bogies as described in the aforesaid patent specification. FIGS. 1 and 2 also show, in broken lines, the positions of the wheels of a bogie 2 and a part 3 of a semi trailer. The adapter comprises a headstock 4 on which buffers 5 are mounted at standard centres as well as a drawhook 6. The headstock also mounts air pipe connections for the braking systems of the train as indicated at 7. The adapter also comprises a cross-member or bolster 8 intended to lie over the bolster of the bogie and carrying means (to be described) for attaching the adapter to the bogie The bolster 8 carries rubbing strips 9, for engaging side bearers 10 on the bogie which serve in conventional manner to control body roll and bogie rotation (see FIG. 5). Two side arms 11 link the headstock 4 and bolster 8 and continue beyond the bolster and terminate in attachment means 12 whereby the adapter may be connected to the semi-trailer and finally reinforcing members 14 extend between the headstock and the bolster. The attachment means 12 is in the form of a pin 12A extending in the intended direction of travel and a support plate 12B at the end of each side arm 11 remote from the headstock 4. An apertured bracket 13 (FIG. 2) is welded to the bottom of the semi-trailer body 3 and receives the pin 12A which can then be locked in position by a transverse pin (not shown).

In some cases there may be problems in making the three point connection of the adapter 1. In order to obviate these problems, the adapter 41 shown in FIG. 4 may be employed. At its front end the adapter 41 is similar to the adapter 1 and has a headstock 44 on which buffers 45 and a drawhook 46 are mounted as well as air pipe connection 47 for the braking systems of the train. The adapter has a bolster 8 linked to the headstock 44 by side arms 411 and the space between the headstock and the bolster 8 is partly covered by plates 44. However, in contradistinction to the adapter shown in FIG. 1 the side arms 411 converge to the rear of the bolster 8 and terminate between cover plates 49 formed with a bell-mouthed slot 410.

Figure 4:
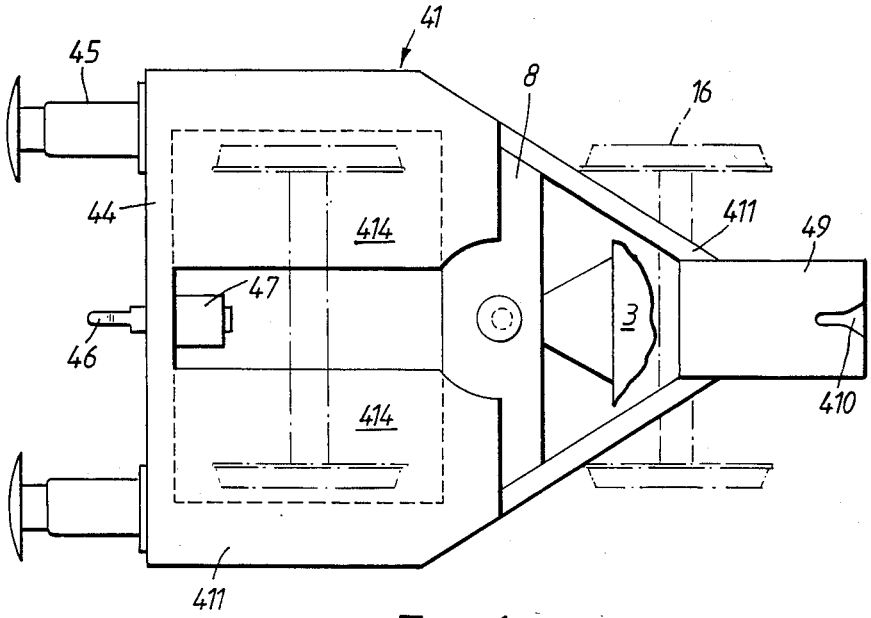
FIG. 4 is a plan view of yet another coupling adapter.

In contradistinction to the adapter described with reference to FIG. 1, the rear end of the adapter shown in FIG. 4 is held in position by the engagement of the fifth wheel pin of the semi-trailer in the slot 410. This engagement is easy to effect and provides a simple and reliable attachment for the rear end of the adapter Of course, should the semi-trailer have no fifth wheel pin, it will be necessary to provide it with an equivalent pin for engagement in the slot 410 of the adapter 41.

Figure 5:
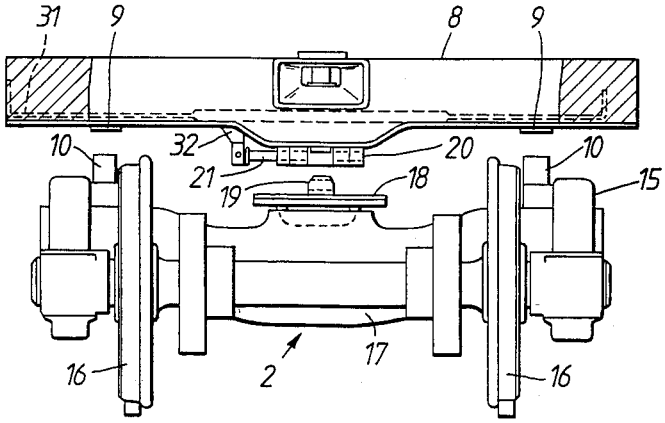
FIG. 5 is a cross-section along the line IV—IV in FIG. 1.
Figure 6:
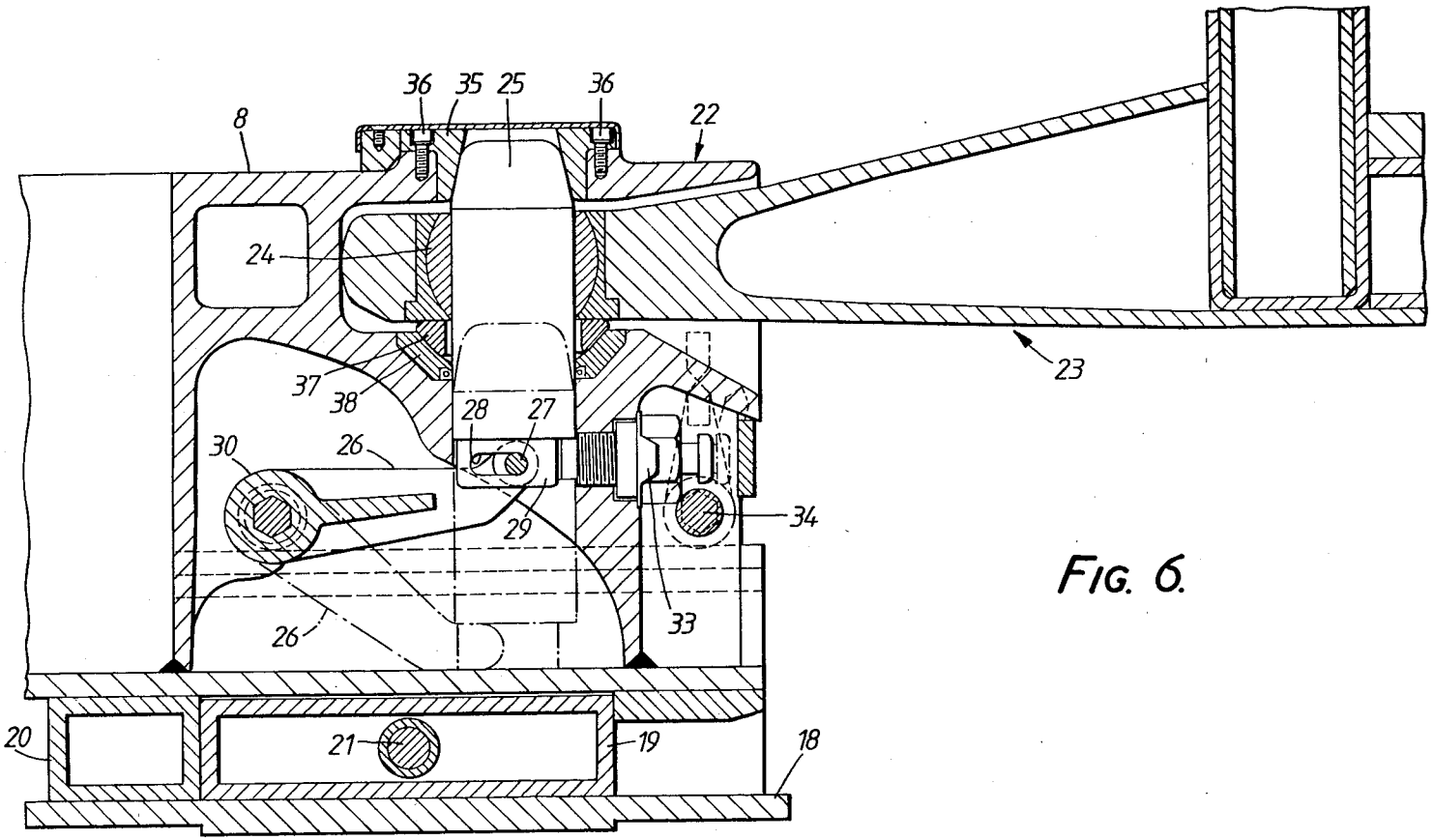
FIG. 6 is a cross-section to an enlarged scale, along the line V—V in FIG. 1.

In the manner described in the aforesaid patent specification the bogie 2 shown in greater detail in FIG. 5 has a substantially conventional H-frame 15 and two pairs of rail wheels 16. The H-frame has a bogie bolster 17 the upper surface of which is formed with part-spherical pocket in which a mating part spherical mounting member is held so as to be universally rockable about a mounting pin. The mounting member is covered by a plate 18 which carries an apertured connecting block 19 for connecting the bogie to the bolster 8 of the adapter. A U-shaped shoe 20 is mounted below the bolster 8 and has a splayed mouth. A retaining pin 21 passes horizontally through the shoe 20 and the arrangement is such that as the bogie and adapter are moved relative to one another the connecting block 19 will enter the mouth of the shoe 20 and be guided by the mouth until it occupies a position where the retaining pin 21 can be passed through the shoe and the aperture in the connecting block to connect the adapter to the bogie. A bar 31 with cranked ends carries a bracket 32 on which the retaining pin 21 is mounted, the bar extending for the full width of the bolster 8 and being so arranged that the retaining pin can be engaged or disengaged from the side of the adapter. This is essentially the same manner in which a semi-trailer is connected to the bogie in making up a train. As shown in FIG. 6, the bolster 8 of the adapter is provided with a socket 22 to receive the coupling tongue 23 of a semi-trailer. The tongue 23 is formed at its end with an aperture in which an apertured ball joint 24 is mounted A pin 25 engages in the aperture in the ball joint to hold the tongue 23 in the socket 13, the ball joint permitting limited movement of the tongue about the pin in any direction. In order to release the coupling, the pin 25 can be lowered from the position shown in full lines in Figure 6 to the position shown in broken lines by means of a bracket 26 engaging a pin 27 movable in a slot 28 in a block 29 attached at the lower end of the pin 25. The bracket 26 is movable by an arm 30 similar to the arm 31. A spring-loaded catch 33 is provided to hold the pin 25 in its coupling position and is deflectable out of the path of movement of the pin 25 by a rod 34, also similar to the rod 31, so that the bracket 26 can be moved downwards.

The upper end of the pin 25 is tapered and is received in a centering ring 35 mounted in the upper part of the bolster 8. The centering ring 35 is held in place by bolts 36 and can be removed to give access to the pin 25 for repair or replacement.

In order to transmit the load from the coupling tongue 23 to the bolster 8 and thence to the bogie 2, the tongue rests on a thrust washer 37 which has a part spherical surface resting on a part spherical bearing member 38. Again this is essentially the same manner in which the tongue of a semi-trailer is connected to an adjacent semi-trailer mounted on a bogie in making up a train.

In order to make up a train, a plurality of bogies and semi-trailers is assembled in the manner described in the aforesaid patent specification. At the front of the train, the adapter is mounted on a bogie in the manner described, and the adapter is then offered up to the tongue 23 of the leading semi-trailer and the tongue is connected in place by the pin 25.

At the same time the ends of the side arms of the adapter 1 engage beneath the floor of the semi-trailer and are secured thereto by the attachment means 12, as indicated in FIG. 2, or the fifth wheel pin is engaged in the slot 410 of the adapter 41.

A conventional locomotive can then be coupled to the adapter to draw the train.

Figure 3:
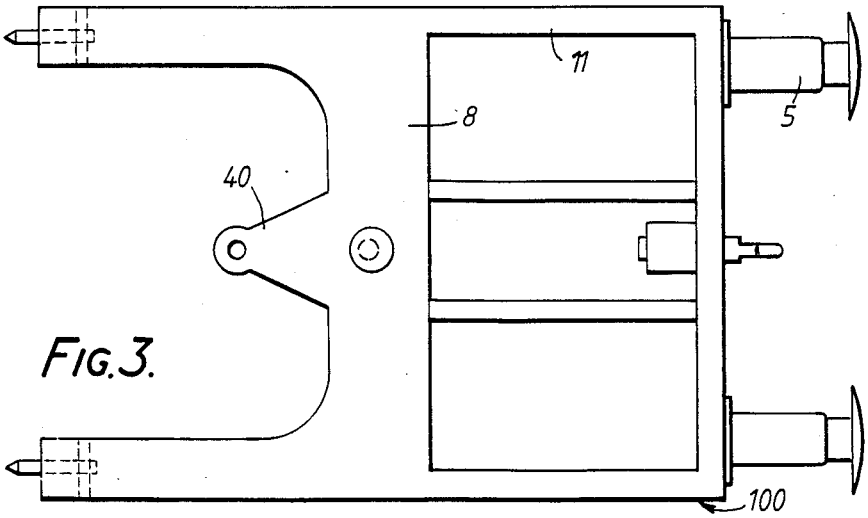
FIG. 3 is a plan view of another coupling adapter.

If, however, it is required to draw the train from the other end, then it will be necessary to use the adapter 100 shown in FIG. 3. This is essentially the same as the adapter 1 shown in FIGS. 1 and 2, but instead of having a socket to receive the coupling tongue at one end of a semi-trailer it is itself provided with a coupling tongue 40 to engage in the socket in a body bolster at the other end of the semi-trailer.

Figure 7:
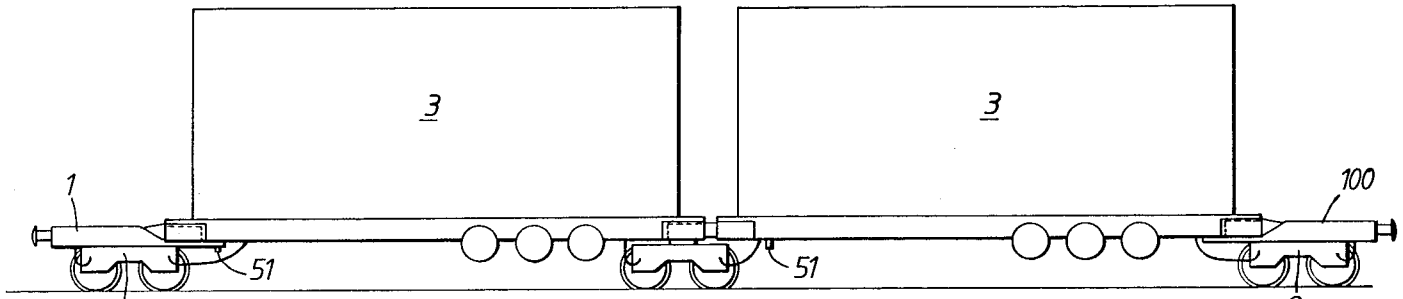
FIG. 7 is a side view of part of a train.

At the rear end of the train, the adapter 100 shown in FIG. 3 may be mounted on a bogie 2 and the tongue 40 then offered up to the socket in the semi-trailer. FIG. 7 shows such a train arrangement of two linked semi-trailers and three bogies with an adapter 1 at one end of the train and an adapter 100 at the other, 51 denoting the fifth wheel pin of the semi-trailer.

Figure 8:
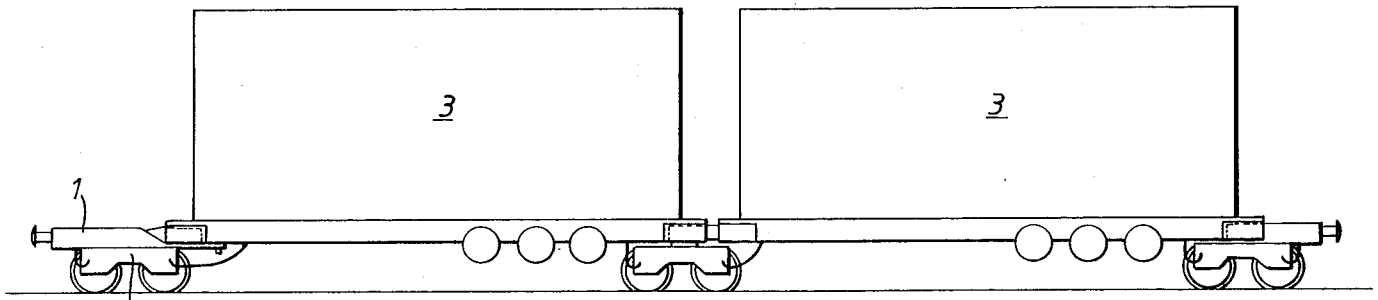
FIG. 8 is a side view of part of another train.

Alternatively, it is possible to mount the trailing end of a semi-trailer on a bogie in the manner described in the aforesaid patent specification and to connect the rear adapter to the body by the two attachment means 12 and the tongue 40 without any direct connection between the body bolster of the bogie and the adapter when the bogie and adapter are installed. Such an arrangement is shown in FIG. 8. In order to facilitate fitting and removal of the adapter a means of supporting the weight of the adapter on the bogie may be fitted to the bogie during assembly or disassembly.

The means of supporting the weight of the adapter on the bogie may be fitted to the bogie whenever the adapter and bogie are to be removed from a semi-trailer. The support could be in the form of trestle brackets resting over the side frames of the bogie with a form of jack included so that the adapter can be raised and lowered. Any support fitted would be removed during normal operation of the train.

It will thus be seen that with the present adapter, the attachment of tongue and socket is identical at all other connecting points along the train, both in structure and method of connection. Any longitudinal load applied to the train through the hook 6 or buffers 5 is applied to the semi-trailers by the tongue or socket fitting. Any movements in plan view created by asymmetry of loading are reacted by transverse loads on the attachment means 12 or the fifth wheel pin and the tongue or socket.

The present adapter enables a train of semi-trailers and bogies to be made compatible with existing rolling stock without the need for adapter bogies as previously proposed. Furthermore, since the adapters can be used at any position along the train, they enable short rakes of trains of semi-trailers and bogies such as shown in FIGS. 6 and 7 to be mixed with conventional rolling stock thus making for more flexible operations.

What is claimed is;

1. In a road and rail transport system comprising a plurality of semi-trailers adapted for over the road travel, coupling means enabling semi-trailers to be releasably connected end to end for rail travel, a plurality of bogies for supporting the semi-trailers and quick release coupling means to permit a plurality of bogies and semi-trailers to be readily assembled to form a train, the improvement comprising an adapter to permit traction of said train or connection of said train in a train comprising conventional rail cars, said adapter comprising a headstock, buffers to said headstock, attachment means for connecting said adapted to a locomotive, a transverse bolster member, side arms connecting the headstock to the bolster, extensions to said side arms extending on the side of the bolster remote from the headstock, means for connecting the ends of said extensions to the base of a semi-trailer, means for releasably connecting the adapter to a bogie, and means for connecting the adapter to a semi-trailer.

2. An adapter as claimed in claim 1, wherein the side arms are parallel to each other for the length of the adapter and each side arm terminates in means for attaching it to the floor of a semi-trailer, whereby a three-point connection of the adapter to the semi-trailer can be effected.

3. An adapter as claimed in claim 1, wherein on the side of the bolster remote from the headstock, the side arms converge and terminate in a member with a slot for engagement with the fifth wheel pin of a semi-trailer.

4. An adapter as claimed in any one of claims 1 to 3, wherein the adapter is provided with a socket to receive a coupling tongue of a leading semi-trailer and with means for locking the coupling tongue in the socket.

5. An adapter as claimed in claim 1 or 2, wherein the adapter is provided with a coupling to engage in a socket in a trailing semi-trailer.

6. An adapter as claimed in any one of claims 1 to 3, wherein the bolster is provided with means whereby the adapter can be releasably connected to a bolster of a bogie.

* * * * *

UNITED STATES PATENT AND TRADEMARK OFFICE

CERTIFICATE OF CORRECTION

PATENT NO. : 4,784,066

DATED : November 15, 1988

INVENTOR(S) : Bruce Richard Ellis

It is certified that error appears in the above-identified patent and that said Letters Patent is hereby corrected as shown below:

Column 2, line 27 delete "f" and insert -- of --.

Column 3, line 64 deleted "mounted A" and insert -- mounted. A --.

Signed and Sealed this

Twentieth Day of March, 1990

*Attest:*

*Attesting Officer*

JEFFREY M. SAMUELS

*Acting Commissioner of Patents and Trademarks*